US011631351B2

(12) United States Patent
Yin et al.

(10) Patent No.: US 11,631,351 B2
(45) Date of Patent: Apr. 18, 2023

(54) CURRENT DETECTION DEVICE AND DISPLAY DEVICE

(71) Applicant: BOE Technology Group Co., Ltd., Beijing (CN)

(72) Inventors: Xinshe Yin, Beijing (CN); Xinbin Han, Beijing (CN); Jianchao Zhu, Beijing (CN); Guangliang Shang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/245,026

(22) Filed: Apr. 30, 2021

(65) Prior Publication Data

US 2022/0044604 A1 Feb. 10, 2022

(30) Foreign Application Priority Data

Aug. 6, 2020 (CN) ..... 202010783282.2

(51) Int. Cl.
*G09G 3/00* (2006.01)
*G09G 3/3208* (2016.01)

(52) U.S. Cl.
CPC ..... *G09G 3/006* (2013.01); *G09G 3/3208* (2013.01); *G09G 2320/0233* (2013.01); *G09G 2330/12* (2013.01)

(58) Field of Classification Search
None
See application file for complete search history.

(56) References Cited

U.S. PATENT DOCUMENTS 10,636,357 B1 * 4/2020 Brownlow ..... G09G 3/32
2017/0162125 A1 * 6/2017 Liang ..... G09G 3/3233
2021/0118383 A1 * 4/2021 Zhang ..... G09G 3/3655

* cited by examiner

*Primary Examiner* — Andre L Matthews
(74) *Attorney, Agent, or Firm* — ArentFox Schiff LLP; Michael Fainberg

(57) ABSTRACT

Disclosed in the embodiments of the present disclosure are a current detection device and a display device. The current detection device includes: a plurality of detection circuits; the detection circuit includes: a feedback compensation circuit and a current detection circuit; and the feedback compensation circuit is configured to generate a noise inversion signal by inverting a noise AC signal generated on the predetermined power line in the display panel and to provide the noise inversion signal to a first end of the current detection circuit; and the current detection circuit is configured to output a detection signal to the signal output end according to the noise inversion signal, the signal on the detection line and the signal of the reference voltage end.

14 Claims, 9 Drawing Sheets

CURRENT DETECTION DEVICE AND DISPLAY DEVICE

The present disclosure claims the priority from Chinese Patent Application No. 202010783282.2, filed with the China National Intellectual Property Administration on Aug. 6, 2020 and entitled "Current Detection Device and Display Device", the entire content of which is hereby incorporated by reference.

FIELD

The present disclosure relates to the technical field of display, in particular to a current detection device and a display device.

BACKGROUND

In the preparation process of display panels, due to the process and other reasons, the thickness and characteristics of the film layer in different areas of the display panel may not be uniform, which may lead to uneven display brightness in different areas, thereby affecting the display effect of the overall image.

SUMMARY

Embodiments of the present disclosure provide a current detection device and a display device.

On the one hand, embodiments of the present disclosure provide a current detection device, including: a plurality of detection circuits, the detection circuits each is connected to a respective one of detection lines in a display panel;

the detection circuit includes: a feedback compensation circuit and a current detection circuit;

a first end of the feedback compensation circuit is electrically connected with a predetermined power line in the display panel, and a second end of the feedback compensation circuit is electrically connected with a first end of the current detection circuit; and the feedback compensation circuit is configured to generate a noise inversion signal by inverting a noise AC signal generated on the predetermined power line in the display panel, and to provide the noise inversion signal to the first end of the current detection circuit; and the first end of the current detection circuit is electrically connected with the respective one detection line in the display panel, a second end of the current detection circuit is electrically connected with a reference voltage end, and an output end of the current detection circuit is electrically connected with a signal output end; and the current detection circuit is configured to output a detection signal to the signal output end according to the noise inversion signal, a signal on the detection line and a signal of the reference voltage end.

In some embodiments, the feedback compensation circuit includes: at least one noise extraction circuit, an inversion processing circuit and a coupling circuit, when each of the feedback compensation circuit comprises a plurality of noise extraction circuits, in the same feedback compensation circuit, different noise extraction circuits are electrically connected with different positions of the predetermined power line;

the at least one noise extraction circuit is configured to extract the noise AC signal at the electrically connected positions of the predetermined power line, and provide the noise AC signal to the inversion processing circuit;

when each of the feedback compensation circuit comprises one noise extraction circuit, the inversion processing circuit is configured to generate the noise inversion signal by inverting the noise signal provided by the noise extraction circuit; or when each of the feedback compensation circuit comprises a plurality of noise extraction circuits, the inversion processing circuit is configured to generate the noise inversion signal by inverting the sum of the noise signals provided by the noise extraction circuits; and the coupling circuit is configured to receive the noise inversion signal, and couple the noise inversion signal to the first end of the current detection circuit.

In some embodiments, the noise extraction circuit includes: a blocking capacitor and a first resistor;

a first end of the blocking capacitor is electrically connected with the corresponding position of the predetermined power line, and a second end of the blocking capacitor is electrically connected with a first end of the first resistor; and a second end of the first resistor is electrically connected with the inversion processing circuit.

In some embodiments, the inversion processing circuit includes: a second resistor and a first operational amplifier;

a negative phase input end of the first operational amplifier is electrically connected with the noise extraction circuit, a positive phase input end of the first operational amplifier is electrically connected with the ground end, and an output end of the first operational amplifier is electrically connected with the coupling circuit; and a first end of the second resistor is electrically connected with the negative phase input end of the first operational amplifier, and the second end of the second resistor is electrically connected with the output end of the first operational amplifier.

In some embodiments, the coupling circuit includes: a coupling capacitor; and a first end of the coupling capacitor is electrically connected with the inversion processing circuit, and a second end of the coupling capacitor is electrically connected with the first end of the current detection circuit.

In some embodiments, the display panel further includes a plurality of scanning lines, and a plurality of overlap capacitors are formed by one of the detection lines and the plurality of scanning lines at overlapping positions; and a difference between a capacitance of the coupling capacitor and a total capacitance of the overlap capacitor satisfies a difference threshold, the difference threshold is $0 \pm \Delta C$, $\Delta C \leq 0.1$.

In some embodiments, the current detection circuit includes: a second operational amplifier, an integrating capacitor and a control switch;

a negative phase input end of the second operational amplifier is taken as the first end of the current detection circuit, a positive phase input end of the second operational amplifier is electrically connected with the reference voltage end, and an output end of the second operational amplifier is electrically connected with the signal output end;

a first end of the integrating capacitor is electrically connected with the negative phase input end of the second operational amplifier, and a second end of the integrating capacitor is electrically connected with the output end of the second operational amplifier; and a first end of the control switch is electrically connected with the negative phase input end of the second operational amplifier, and a second end of the control switch is electrically connected with the output end of the second operational amplifier.

In some embodiments, the current detection circuit further includes: a holding capacitor; and a first end of the holding capacitor is electrically connected with the output end of the second operational amplifier, and a second end of the holding capacitor is electrically connected with a ground end.

On the other hand, embodiments of the present disclosure further provide a display device, including: a display panel and the above current detection device;

the display panel includes a display area and a non-display area;

the display area includes a plurality of sub-pixels and the plurality of detection lines, each of the sub-pixels includes a pixel circuit; and one column of the pixel circuits are electrically connected with one of the detection lines;

the non-display area includes the predetermined power line;

the feedback compensation circuit in each of the detection circuits is respectively electrically connected with the predetermined power line; and the first end of the current detection circuit in each of the detection circuits is electrically connected to a respective one of detection lines in a display panel.

In some embodiments, when each of the feedback compensation circuit includes a noise extraction circuit, the noise extraction circuit in each of the feedback compensation circuits is electrically connected with the same position in the predetermined power line.

In some examples, when each of the feedback compensation circuit includes a plurality of noise extraction circuits, in the same feedback compensation circuit, different noise extraction circuits are electrically connected with different positions of the predetermined power line; and the noise extraction circuits in different feedback compensation circuit are electrically connected with the same position in the predetermined power line.

DETAILED DESCRIPTION OF THE EMBODIMENTS

Figure 1:
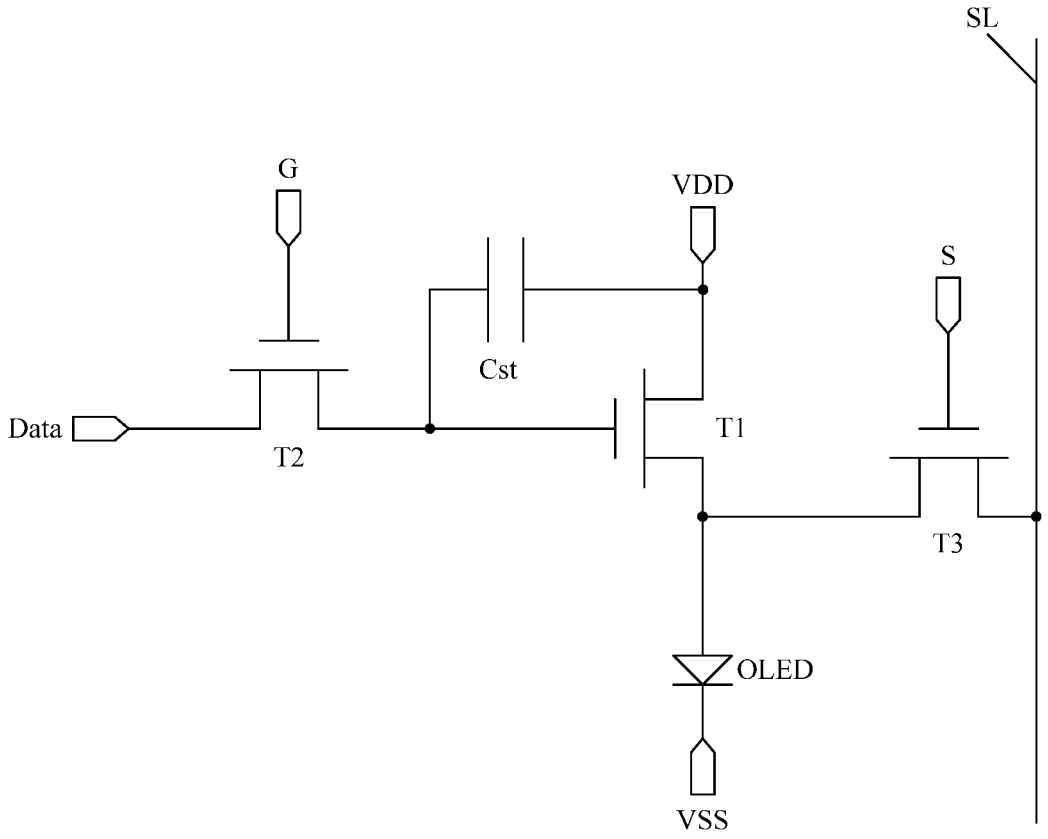
FIG. 1 is a schematic diagram of a pixel circuit, provided by embodiments of the present disclosure.

To make the objectives, technical solutions and advantages of embodiments of the present disclosure clearer, the technical solutions in embodiments of the present disclosure will be described below clearly and completely in conjunction with the accompanying drawings in embodiments of the present disclosure. Obviously, the described embodiments are only a part of embodiments of the present disclosure, and not all the embodiments. Moreover, embodiments in the present disclosure and the characteristics in embodiments can be combined with each other without conflict. Based on embodiments described in the present disclosure, all the other embodiments obtained by those of ordinary skills in the art without creative work fall within the protection scope of the present disclosure.

Unless otherwise defined, technical or scientific terms used in the present disclosure have ordinary meanings understood by those of ordinary skills in the art to which the present disclosure pertains. The words "first", "second" and the like used in the present disclosure do not indicate any order, quantity or importance, but are only used to distinguish different components. Words such as "comprise" or "include" mean that an element or item appearing before such a word covers listed elements or items appearing after the word and equivalents thereof, and do not exclude other elements or items. Words such as "connect" or "interconnect" are not limited to physical or mechanical connections, but may include electrical connections, regardless of direct or indirect connection.

It should be noted that, sizes and shapes in the drawings do not reflect the true scale, and are merely intended to schematically illustrate the present disclosure. Furthermore, the same or similar reference numerals throughout represent the same or similar elements or elements having the same or similar functions.

With such advantages as self-illumination and low energy consumption, such electroluminescent diodes as organic light emitting diodes (OLEDs) and quantum dot light emitting diodes (QLEDs) become one of the hot spots in the research field of the existing electroluminescent display panel. The electroluminescent diodes belong to current-driven light-emitting devices, and require a stable current to drive them to emit light. After the electroluminescent diodes are applied to the display panel, a pixel circuit is generally adopted to drive the electroluminescent diodes to emit light.

Figure 2:
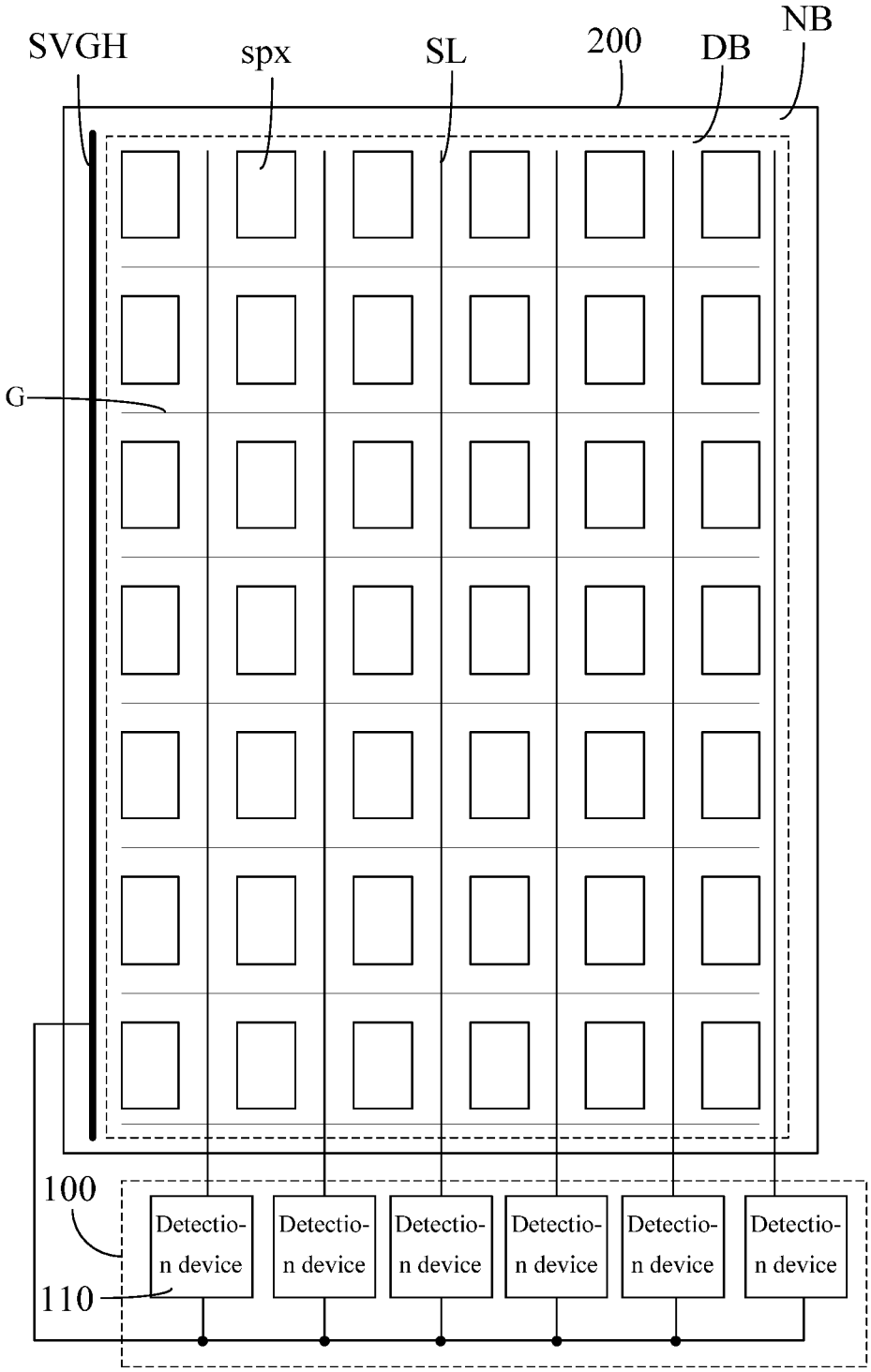
FIG. 2 is a schematic diagram of a display panel, provided by embodiments of the present disclosure.

In some embodiments, as shown in FIG. 2, the display panel 200 can include: a display area DB and a non-display area NB surrounding the display area DB. The display area DB can include a plurality of pixel circuits arranged in an array. Each pixel circuit includes a plurality of sub-pixels spx. Exemplarily, the pixel circuit can include a red sub-pixel, a green sub-pixel and a blue sub-pixel, in this way, color display can be achieved through mixing red light, green light and blue light respectively emitted by the red sub-pixel, the green sub-pixel and the blue sub-pixel. Or, a pixel unit can also include a red sub-pixel, a green sub-pixel, a blue sub-pixel and a white sub-pixel, in this way, color display can be achieved through mixing red light, green light, blue light and white light respectively emitted by the red sub-pixel, the green sub-pixel, the blue sub-pixel and the white sub-pixel. Of course, during practical applications, the light emitting color of the sub-pixel spx in the pixel circuit can be designed and determined according to practical application environment, which is not limited herein.

In some embodiments, the sub-pixel spx can include an electroluminescent diode and a pixel circuit configured to drive the electroluminescent diode to emit light. The electroluminescent diode includes an anode, a light emitting functional layer and a cathode layer which are arranged in a stacked manner. The light emitting functional layer can include: a hole injection layer arranged between the anode and the cathode layer, a hole transport layer arranged between the hole injection layer and the cathode layer, an organic light emitting layer arranged between the hole transport layer and the cathode layer, a hole blocking layer arranged between the organic light emitting layer and the cathode layer, and an electronic transport layer arranged between the hole blocking layer and the cathode layer.

In some embodiments, as shown in FIG. 1, the pixel circuit can include: a drive transistor T1, a switch transistor T2 and a capacitor Cst. The pixel circuit controls the switch transistor T2 to turn on to write the data voltage of the data signal end Data into the gate of the drive transistor T1, and controls the drive transistor T1 to generate operating current to drive the electroluminescent diode L to emit light. The drive current Ids of the drive transistor T1 can be represented by the following formula: $Ids=k(VGS-Vth)^2=k(Vda-Vdd-Vth)^2$, $k=\frac{1}{2}\mu C$ or $$\frac{W}{L};$$

μ represents mobility rate of the drive transistor T1, Cox represents the capacitance of a gate oxide in unit area, W represents the width of a channel of the drive transistor T1, and L represents the length of the channel of the drive transistor T1; VGS represents the voltage difference between the gate voltage of the drive transistor T1 and the source voltage of the drive transistor T1, Vth represents the threshold voltage of the drive transistor T1, Vda represents the data voltage of the data signal end Data, and Vdd represents the voltage of the VDD power end. However, in different pixel circuits, the threshold voltage Vth of the drive transistor T1 and the mobility rate μ of the drive transistor T1 may be different, resulting the brightness of pixels to be different under the same grayscale. Meanwhile, along with an increase in the service time, the drive transistor T1 will be aged, then the threshold voltage of the drive transistor T1 and the mobility rate of the drive transistor T1 will drift, and the difference between the display brightness of different sub-pixels will be increased. To ensure display quality, the threshold voltage of the drive transistor and the mobility rate of the drive transistor can be compensated through external compensation. In some embodiments, a detection line SL needs to be arranged in the display area DB of the display panel 200 and a detection transistor T3 which is electrically connected with the drain of the drive transistor T1 needs to be arranged in the pixel circuit. Moreover, as shown in FIG. 2, the detection transistor T3 in a row of pixel circuits is electrically connected with a detection line SL. In combination with FIG. 3, when a row of sub-pixels spx in the display panel 200 are compensated, in the t01 stage, the signal S1 controls the detection transistor T3 to be turned off, and the signal G1 transmitted on the scanning line controls the switch transistor T2 to be turned on, so as to write the data voltage of the data signal end Data into the gate of the drive transistor T1, and control the drive transistor T1 to generate operating current Ids. In the t02 stage, the signal G1 transmitted on the scanning line controls the switch transistor T2 to be turned off, and the signal S1 controls the detection transistor T3 to be turned on, such that the operating current Ids generated by the drive transistor T1 flows into the detection line SL, and the detection line SL inputs constant current Ids. Afterwards, external compensation of the drive transistor T1 can be performed through collecting the current Ids on the detection line SL.

However, in combination with what is shown in FIG. 1 and FIG. 2, the display area DB of the display panel 200 further includes a plurality of scanning lines G, the switch transistor T2 in a row of sub-pixels spx is electrically connected with one scanning line, such that the extension direction of the scanning line is intersected with the extension direction of the detection line SL, then overlap capacitors are formed by the detection line SL and these scanning lines. Due to the effect of the overlap capacitor, when the signal on the scanning line is fluctuated, the current signal transmitted on the detection line SL will be changed, then the detected current on the detection line SL is not accurate, thereby further leading to the external compensation is not accurate and influencing the display effect of the picture.

Figure 3:
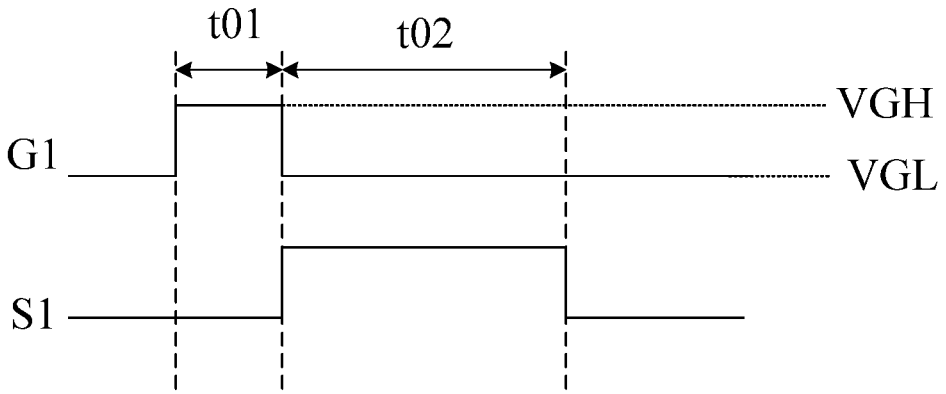
FIG. 3 is a signal sequence chart, provided by embodiments of the present disclosure.

It should be noted that, the fluctuation of the signal on the scanning line can mean that, in combination with FIG. 1 and FIG. 3, the signal G1 on the scanning line G may be a high level signal VGH or a low level signal VGL. In one case, when the switch transistor T2 is an N-type transistor, the high level signal VGH controls the switch transistor T2 to be turned on, and the low level signal VGL controls the switch transistor T2 to be turned off Therefore, in one display frame, the low level signal VGL is kept in the display panel 200 for a long time. If the low level signal VGL fluctuates (the fluctuation generally occurs to AC signal), the current signal transmitted on the detection line SL will be changed greatly, even if noise signal exists on the detection line SL, at this time, the influence of the fluctuation of the low level signal VGL on display can be prioritized.

In another case, when the switch transistor T2 is a P-type transistor, the high level signal VGH controls the switch transistor T2 to be turned off, and the low level signal VGL controls the switch transistor T2 to be turned on. Therefore, in one display frame, the high level signal VGH is kept in the display panel 200 for a long time. If the high level signal VGH fluctuates (the fluctuation generally occurs to AC signal), the current signal transmitted on the detection line SL will be changed greatly, even if noise signal exists on the detection line SL, at this time, the influence of the fluctuation of the high level signal VGH on display can be prioritized.

In some embodiments, the high level signal VGH in the signal G1 transmitted on the scanning line can be provided by the high voltage signal line SVGH (that is, transmitting high level signal VGH) connected with the gate drive circuit (that is, a GOA circuit) of the display panel 200; and the low level signal VGL in the signal G1 transmitted on the scanning line can be provided by the low voltage signal line SVGL (that is, transmitting the low level signal VGL) connected with the gate drive circuit (that is, a GOA circuit) of the display panel 200. That is, the signal G1 which is formed by the high level signal VGH or low level signal VGL is input into the scanning line through the gate drive circuit. In some embodiments, when the influence of the fluctuation of the low level signal VGL on the display is prioritized, the predetermined power line in the display panel 200 can be set to a low voltage signal line. When the influence of the fluctuation of the high level signal VGH on the display is prioritized, the predetermined power line in the display panel 200 can be set to a high voltage signal line SVGH, which is not limited herein. The predetermined power line in the display panel 200 being set to a high voltage signal line SVGH will be taken as an example for illustration below.

Figure 4:
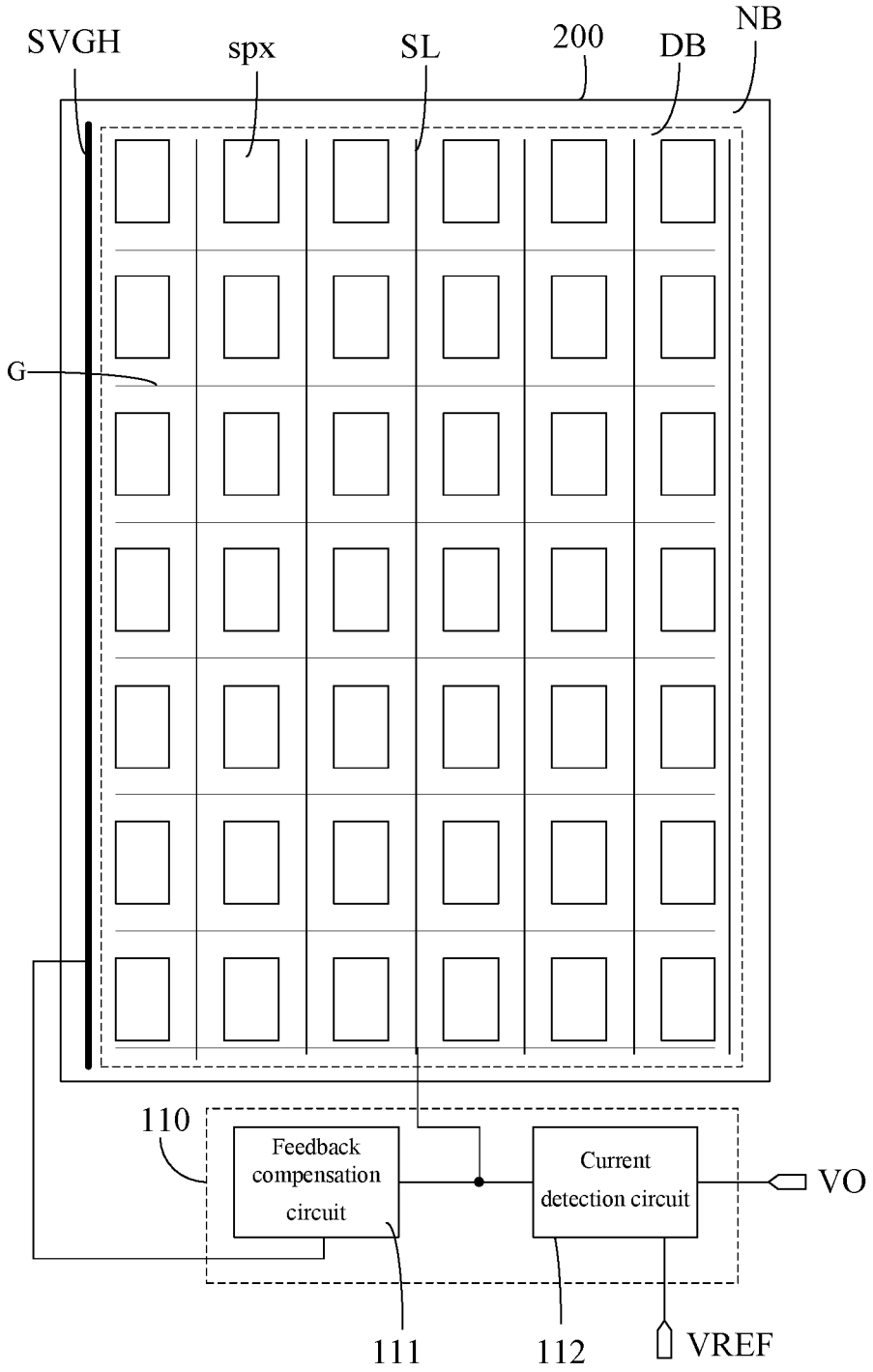
FIG. 4 is another schematic diagram of a display panel, provided by embodiments of the present disclosure.

Embodiments of the present disclosure provide a current detection device 100, as shown in FIG. 2 and FIG. 4, the current detection device 100 includes a plurality of detection circuits 110, the detection circuits 110 each is connected to a respective one of detection lines SL in a display panel 200;

the detection circuit 110 includes: a feedback compensation circuit 111 and a current detection circuit 112;

a first end of the feedback compensation circuit 111 is electrically connected with a predetermined power line (such as the high voltage signal line SVGH in FIG. 2 and FIG. 4) in the display panel 200, and a second end of the feedback compensation circuit 111 is electrically connected with a first end of the current detection circuit 112; and the feedback compensation circuit 111 is configured to generate a noise inversion signal by inverting a noise AC signal generated on the predetermined power line (such as the high voltage signal line SVGH in FIG. 2 and FIG. 4) in the display panel 200 and to provide the noise inversion signal to the first end of the current detection circuit 112; and the first end of the current detection circuit 112 is configured to be electrically connected with the respective one detection line SL in the display panel 200, a second end of the current detection circuit 112 is electrically connected with a reference voltage end VREF, and an output end of the current detection circuit 112 is electrically connected with a signal output end VO; and the current detection circuit 112 is configured to output a detection signal to the signal output end VO according to the noise inversion signal, a signal on the detection line SL and a signal of the reference voltage end.

In some embodiments, the detection circuits are arranged in the non-display area of the display panel, and the detection circuit is connected to the detection line in the display area in a one-to-one correspondence. The detection circuit includes a feedback compensation circuit and a current detection circuit, the noise AC signal generated on the predetermined power line in the display panel is inverted through the feedback compensation circuit, to generate a noise inversion signal; then the noise inversion signal is provided to the first end of the current detection circuit. Since the first end of the current detection circuit is electrically connected with the detection line in the display panel, and the current detection circuit outputs detection signals to the signal output end according to the noise inversion signal, the signal on the detection line and the signal of the reference voltage end, the noise inversion signal can be compensated onto the detection line, then the noise inversion signal can neutralize the noise signals on the detection line, thereby further reducing influence of the noise signal on the current signal transmitted on the detection line, and improving detection accuracy.

Figure 5:
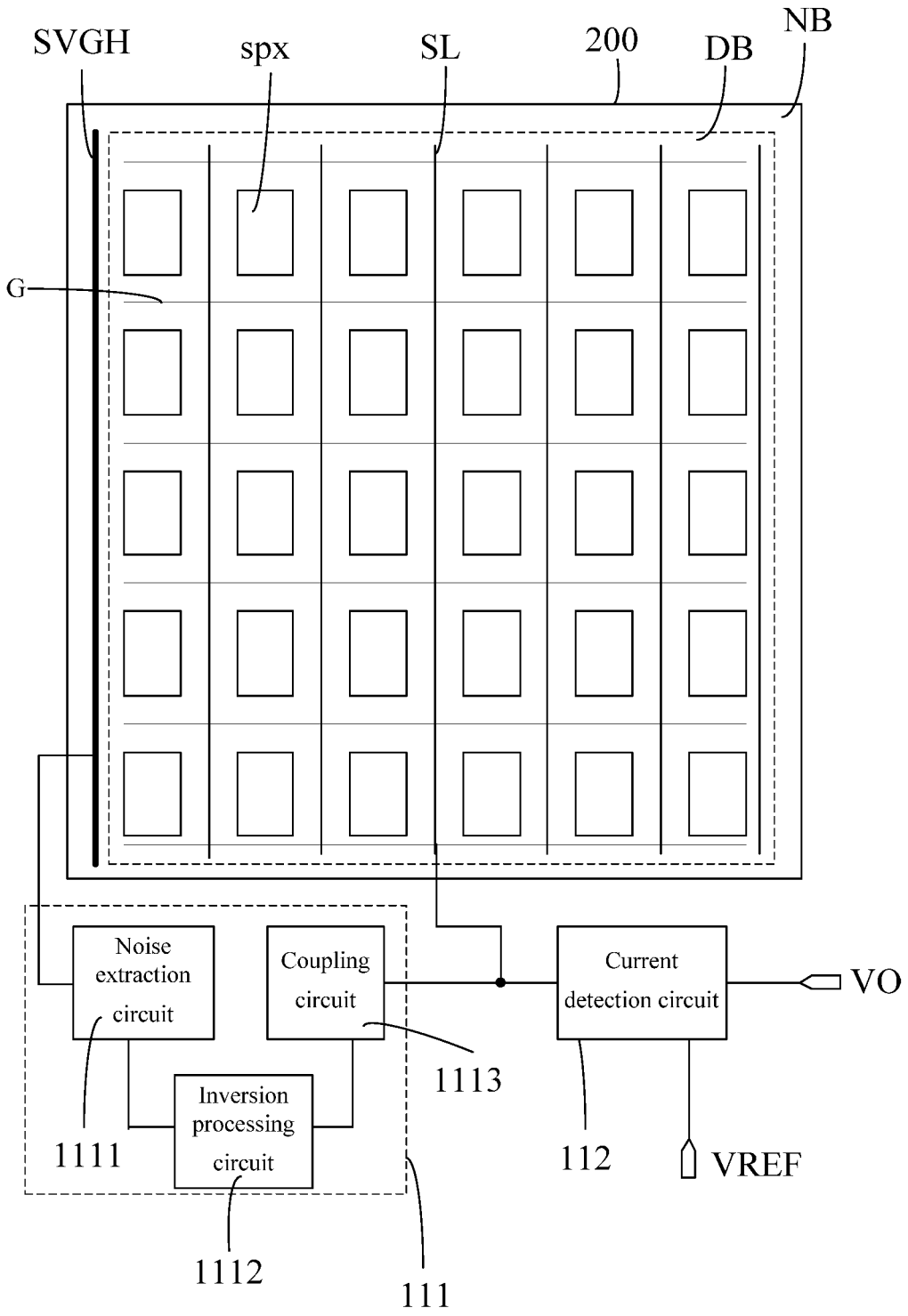
FIG. 5 is another schematic diagram of a display panel, provided by embodiments of the present disclosure.

In some embodiments, as shown in FIG. 4 and FIG. 5, the feedback compensation circuit 111 includes: at least one noise extraction circuit 1111 (such as including one noise extraction circuit 1111 as shown in FIG. 5), an inversion processing circuit 1112 and a coupling circuit 1113; when each of the feedback compensation circuit includes a plurality of noise extraction circuits, in the same feedback compensation circuit, different noise extraction circuits are electrically connected with different positions of the predetermined power line;

the at least one noise extraction circuit 1111 is configured to extract the noise AC signal at the electrically connected positions of the predetermined power line, and provide the noise AC signal to the inversion processing circuit 1112;

when each of the feedback compensation circuit 111 includes one noise extraction circuit 1111, the inversion processing circuit 1112 is configured to generate the noise inversion signal by inverting the noise signal provided by the noise extraction circuit 1111; or when each of the feedback compensation circuit 111 includes a plurality of noise extraction circuits 1111, the inversion processing circuit 1112 is configured to generate the noise inversion signal by inverting the sum of the noise signals provided by the noise extraction circuits 1111; and the coupling circuit 1113 is configured to receive the noise inversion signal, and couple the noise inversion signal to the first end of the current detection circuit 112.

Figure 6:
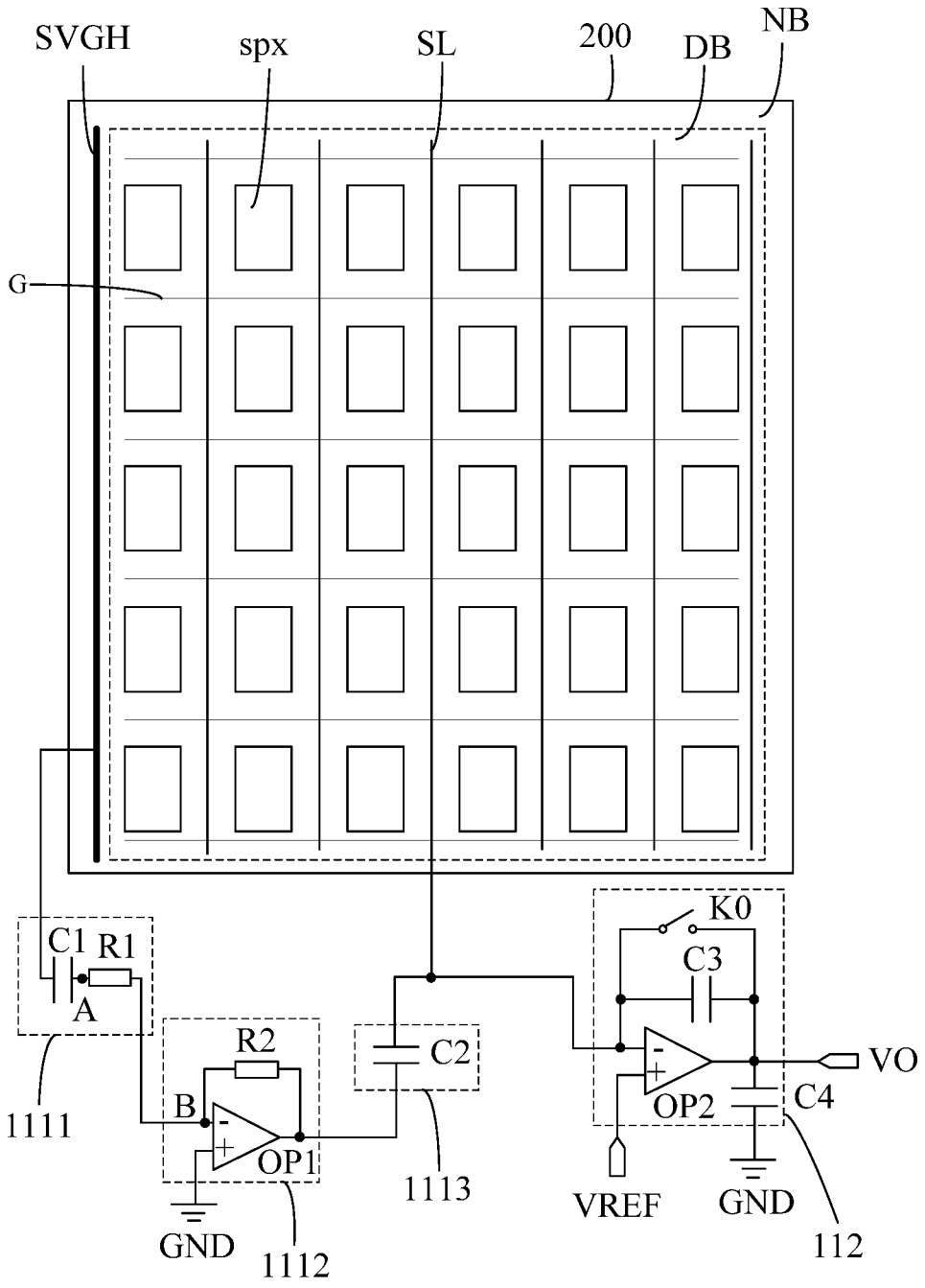
FIG. 6 is another schematic diagram of a display panel, provided by embodiments of the present disclosure.

In some embodiments, as shown in FIG. 6, the noise extraction circuit 1111 includes: a blocking capacitor C1 and a first resistor R1; a first end of the blocking capacitor C1 is electrically connected with the corresponding position of the predetermined power line, and a second end of the blocking capacitor C1 is electrically connected with a first end of the first resistor R1; and a second end of the first resistor R1 is electrically connected with the inversion processing circuit 1112.

In some embodiments, as shown in FIG. 6, the inversion processing circuit 1112 includes: a second resistor R2 and a first operational amplifier OP1; a negative phase input end of the first operational amplifier OP1 is electrically connected with the noise extraction circuit 1111 (for example, the negative phase input end of the first operational amplifier OP1 is electrically connected with a second end of the first resistor R1), a positive phase input end of the first operational amplifier OP1 is electrically connected with the ground end GND, and an output end of the first operational amplifier OP1 is electrically connected with the coupling circuit 1113; and a first end of the second resistor R2 is electrically connected with the negative phase input end of the first operational amplifier OP1, and the second end of the second resistor R2 is electrically connected with the output end of the first operational amplifier OP1.

In some embodiments, when the feedback compensation circuit 111 includes one noise extraction circuit 1111, the resistance of the first resistor R1 can be equal to the resistance of the second resistor R2, in this way, the magnification of the first operational amplifier OP1 can be −1. Of course, during practical application, the resistance of the first resistor R1 and the resistance of the second resistor R2 can be designed and determined according to the requirements of practical application environment, which is not limited herein.

In some embodiments, as shown in FIG. 6, the coupling circuit 1113 includes: a coupling capacitor C2; a first end of the coupling capacitor C2 is electrically connected with the inversion processing circuit 1112 (for example, a first end of the coupling capacitor C2 is electrically connected with an output end of the first operational amplifier OP1), and a second end of the coupling capacitor C2 is electrically connected with the first end of the current detection circuit 112.

In some embodiments, as shown in FIG. 6, the display panel further includes a plurality of scanning lines G; a plurality of overlap capacitors are formed by one detection line SL and a plurality of scanning lines G at overlapping positions; and a difference between a capacitance of the coupling capacitor C2 and a capacitance of the overlap capacitor satisfies a difference threshold, wherein the difference threshold is $0 \pm \Delta C$, $\Delta C \leq 0.1$. For example, $\Delta C$ can be 0.1, or $\Delta C$ can also be 0.05, or $\Delta C$ can also be 0.001. Since in the practical preparation process, the capacitance of the coupling capacitor C2 cannot be completely identical to the capacitance of the overlap capacitor, in this way, when the difference between the capacitance of the coupling capacitor C2 and the capacitance of the overlap capacitor satisfies a difference threshold, the capacitance of the coupling capacitor C2 can be deemed to be equal to the capacitance of the overlap capacitor. During practical application, the numerical value of ΔC can be as small as possible, such that the capacitance of the coupling capacitor C2 can be deemed to be equal to the capacitance of the overlap capacitor, and the numerical value of ΔC can be designed and determined according to practical application environment, which is not limited herein.

In some embodiments, as shown in FIG. 6, the current detection circuit 112 includes: a second operational amplifier OP2, an integrating capacitor C3 and a control switch K0; a negative phase input end of the second operational amplifier OP2 is taken as the first end of the current detection circuit 112, a positive phase input end of the second operational amplifier OP2 is electrically connected with the reference voltage end VREF, and an output end of the second operational amplifier OP2 is electrically connected with the signal output end VO; a first end of the integrating capacitor C3 is electrically connected with the negative phase input end of the second operational amplifier OP2, and a second end of the integrating capacitor C3 is electrically connected with the output end of the second operational amplifier OP2; a first end of the control switch K0 is electrically connected with the negative phase input end of the second operational amplifier OP2, and a second end of the control switch K0 is electrically connected with the output end of the second operational amplifier OP2.

In some embodiments, as shown in FIG. 6, the current detection circuit 112 further includes: a holding capacitor C4; a first end of the holding capacitor C4 is electrically connected with the output end of the second operational amplifier OP2, and a second end of the holding capacitor C4 is electrically connected with a ground end GND.

In some embodiments, as shown in FIG. 6, the control switch K0 can include: a thin film transistor (TFT) and a metal oxide semiconductor (MOS).

A detailed description will be given below on the present disclosure with the structure shown in FIG. 6 as an example and in combination with embodiments. It should be noted that, the present embodiments are used for better explaining the present disclosure, rather than limiting the present disclosure.

Figure 7:
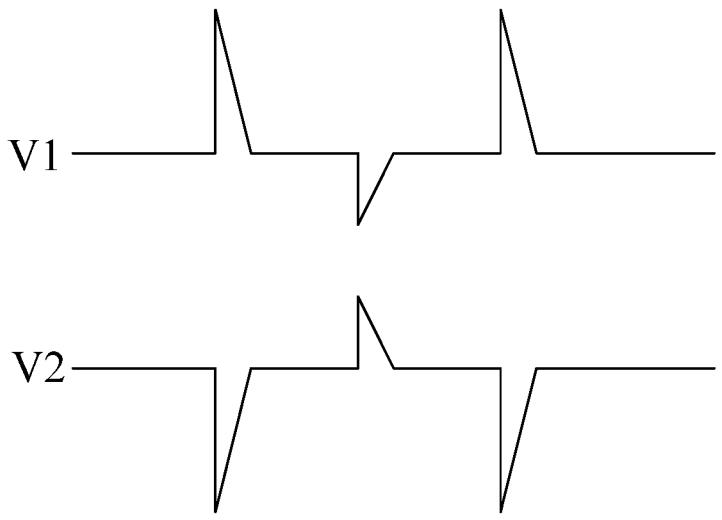
FIG. 7 is a sequence chart of some other signals, provided by embodiments of the present disclosure.

The high voltage signal line SVGH is mainly used for transmitting DC high level signal VGH, if a noise AC signal V1 as shown in FIG. 7 exists in the high voltage signal line SVGH, through the effect of the blocking capacitor C1, the noise AC signal V1 can be extracted to point A. According to the principles of virtual open circuit and virtual short circuit of the first operational amplifier OP1, the voltage of the negative phase input end of the first operational amplifier OP1 can be the voltage of the ground end GND, that is, the voltage at point B is 0V. Since the resistance of the first resistor R1 is equal to the resistance of the second resistor R2, the output end of the first operational amplifier OP1 can output the noise inversion signal V2 as shown in FIG. 7. When the noise AC signal V1 as shown in FIG. 7 exists in the high voltage signal line SVGH, the noise AC signal V1 as shown in FIG. 7 also exists on the detection line SL. When the noise inversion signal V2 as shown in FIG. 7 and output by the output end of the first operational amplifier OP1 is fed back onto the detection line SL, the noise inversion signal V2 can be neutralized with the noise AC signal V1 on the detection line SL, therefore, the fluctuation on the detection line SL is lowered and even eliminated.

Moreover, in combination with FIG. 3, when a row of sub-pixels spx in the display panel 200 are compensated, in the t01 stage, the control switch K0 is closed, and the voltage on the detection line SL is the voltage Vref of the reference voltage end VREF. The signal S1 controls the detection transistor T3 to turn off, the signal G1 transmitted on the scanning line controls the switch transistor T2 to turn on, so as to write the data voltage of the data signal end Data into the gate of the drive transistor T1, and control the drive transistor T1 to generate operating current Ids. In the t02 stage, the signal G1 transmitted on the scanning line controls the switch transistor T2 to turn off, and the signal S1 controls the detection transistor T3 to turn on, such that the operating current Ids generated by the drive transistor T1 flows into the detection line SL, that is, the detection line SL inputs constant current Ids. When the control switch K0 is switched to turn off from closed, the constant current Ids on the detection line SL charges the integrating capacitor C3, such that the voltage difference at two ends of the integrating capacitor C3 is as follows: Vc3=Ids*t/c3; and, t is the duration of t02 stage, c3 is the capacitance of the integrating capacitor C3. In this way, the output end of the second operational amplifier OP2 can output voltage Vout to the signal output end VO, and Vout=Vref−Vc3. In this way, the accuracy of the voltage Vc3 can be higher, and the detection accuracy can be improved. Afterwards, external compensation can be performed through voltage Vc3.

Figure 8:
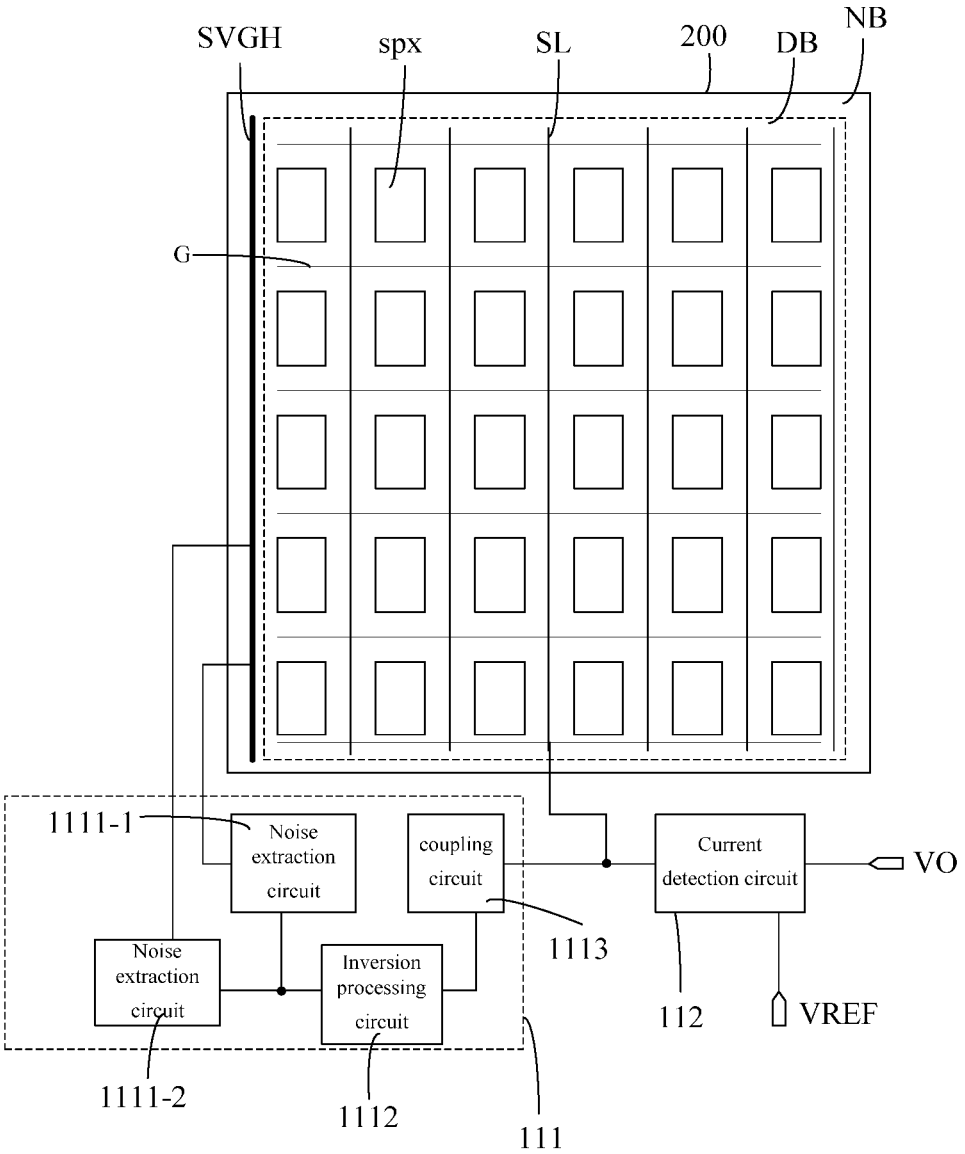
FIG. 8 is a schematic diagram of some other structures of a display panel, provided by embodiments of the present disclosure.

Embodiments of the present disclosure further provide another current detection device, the structural schematic diagram is as shown in FIG. 8, and transformation is made for the implementation manner of the above embodiments. Only the distinguishment between the present embodiment and the above embodiments is described below, and the same part will not be repeated redundantly herein.

In some embodiments, as shown in FIG. 8, the feedback compensation circuit 111 includes: a plurality of noise extraction circuits 1111-*q* (1≤q≤Q, q and Q are both integers, Q is an integer greater than 1, and Q=2 is taken as an example in FIG. 8), an inversion processing circuit 1112 and a coupling circuit 1113; different noise extraction circuits 1111-*q* are electrically connected with different positions of the predetermined power line;

the noise extraction circuit 1111-*q* is configured to extract the noise AC signal at the electrically connected positions of the predetermined power line, and provide the noise AC signal to the inversion processing circuit 1112;

the inversion processing circuit 1112 is configured to additively invert the noise AC signals provided by each of the noise extraction circuits 1111-*q* to generate the noise inversion signal; and the coupling circuit 1113 is configured to receive the noise inversion signal, and couple the noise inversion signal to a first end of the current detection circuit 112.

Figure 9:
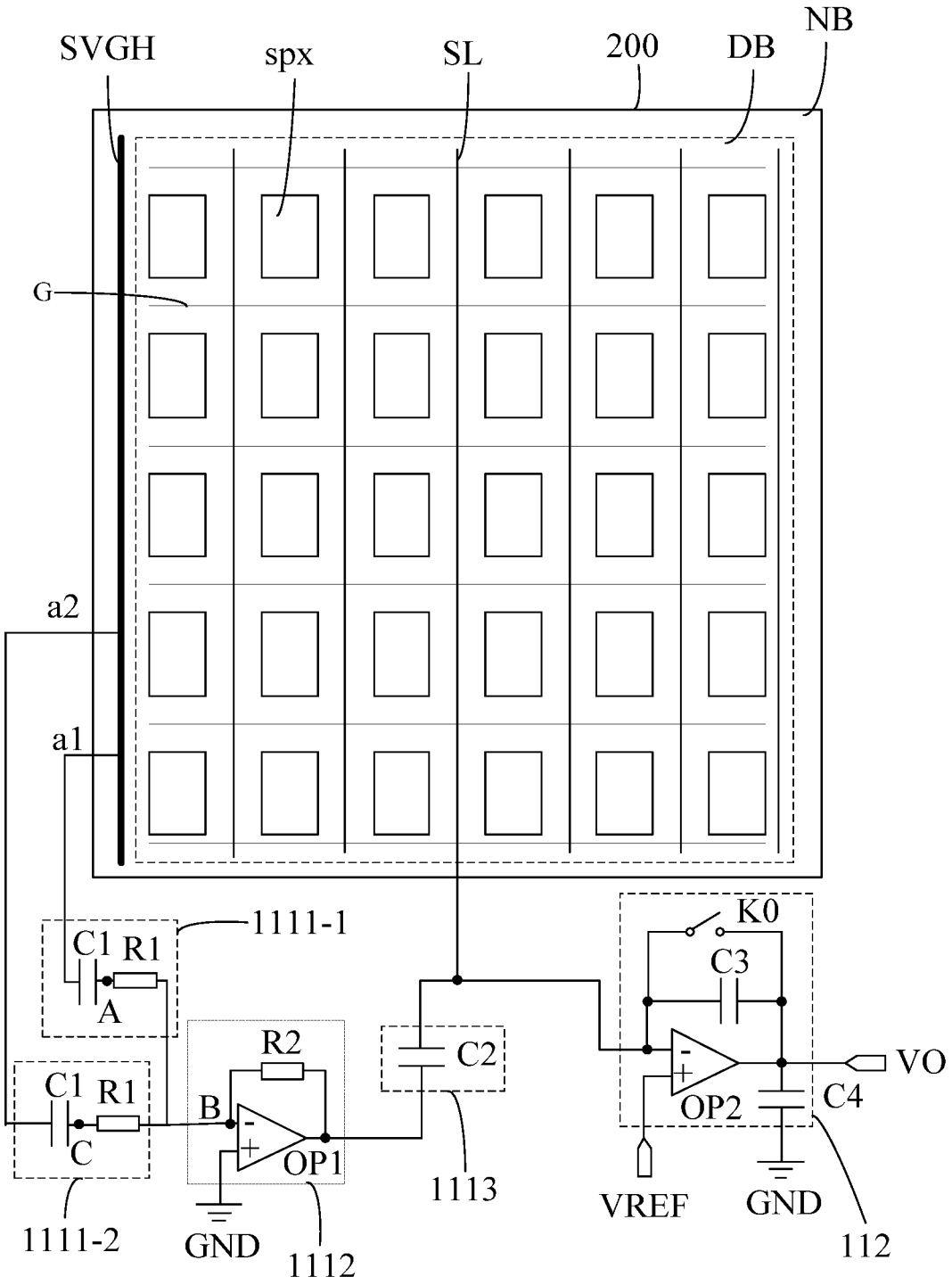
FIG. 9 is another schematic diagram of some other structures of a display panel, provided by embodiments of the present disclosure.

In some embodiments, as shown in FIG. 9, each noise extraction circuit 1111-*q* includes: a blocking capacitor C1 and a first resistor R1; a first end of the blocking capacitor C1 is electrically connected with the corresponding position of the predetermined power line, and a second end of the blocking capacitor C1 is electrically connected with a first end of the first resistor R1; and a second end of the first resistor R1 is electrically connected with the inversion processing circuit 1112. In some embodiments, the resistance of the first resistor R1 in each noise extraction circuit 1111-*q* is the same. Of course, during practical application, the resistance of the first resistor R1 can be designed according to the requirement of the practical application environment, which is not limited herein.

In some embodiments, as shown in FIG. 9, the inversion processing circuit 1112 includes: a second resistor R2 and a first operational amplifier OP1; a negative phase input end of the first operational amplifier OP1 is electrically connected with the noise extraction circuit 1111-*q* (for example, the negative phase input end of the first operational amplifier OP1 is electrically connected with a second end of the first resistor R1 in the noise extraction circuit 1111-*q*), a positive phase input end of the first operational amplifier OP1 is electrically connected with the ground end GND, and an output end of the first operational amplifier OP1 is electrically connected with the coupling circuit 1113; and a first end of the second resistor R2 is electrically connected with the negative phase input end of the first operational amplifier OP1, and the second end of the second resistor R2 is electrically connected with the output end of the first operational amplifier OP1. In some embodiments, the resistance of the first resistor R1 can ben times the resistance of the second resistance R2. And, n can be a numerical value no less than 1. For example, n=1, or n=2, or n=3, etc. During practical application, the specific numerical value of n can be designed and determined according to the requirements of practical application, which is not limited herein.

A detailed description will be given below on the present disclosure with the structure shown in FIG. 9 as an example and in combination with embodiments. It should be noted that, the present embodiment is used for better explaining the present disclosure, rather than limiting the present disclosure.

The high voltage signal line SVGH is mainly used for transmitting DC high level signal VGH, if a noise AC signal V11 exists at position a1 of the high voltage signal line SVGH, through the effect of the blocking capacitor C1 in the noise extraction circuit 1111-1, the noise AC signal V11 can be extracted to point A. If a noise AC signal V12 exists at position a2 of the high voltage signal line SVGH, through the effect of the blocking capacitor C1 in the noise extraction circuit 1111-2, the noise AC signal V12 can be extracted to point C. According to the principles of virtual open circuit and virtual short circuit of the first operational amplifier OP1, the voltage of the negative phase input end of the first operational amplifier OP1 can be the voltage of the ground end GND, that is, the voltage at point B is 0V. Since the resistance r1 of the first resistor R1 is n times the resistance r2 of the second resistor R2. That is, r1=nr0, then the current generated by the voltage v11 of the noise AC signal V11 after the voltage v11 passes through the first resistor R1 in the noise extraction circuit 1111-1 is v11/nr0, the current generated by the voltage v12 of the noise AC signal V12 after the voltage v12 passes through the first resistor R1 in the noise extraction circuit 1111-2 is v12/nr0. Therefore, the current passing through the second resistor R2 is v11/nr0+v12/nr0, and the voltage drop of the second resistor R2 is r*(v11/nr0+v12/nr0), such that the voltage output by the output end of the first operational amplifier OP1 is 0−(v11+v12)/r0. Therefore, the output end of the first operational amplifier OP1 can output proper noise inversion signals through setting the resistance of the first resistor R1 and the second resistor R2. In this way, when the noise inversion signal output by the output end of the first operational amplifier OP1 is fed back onto the detection line SL, the noise inversion signal can be neutralized with the noise AC signal on the detection line SL, therefore, the fluctuation on the detection line SL is lowered and even eliminated.

Moreover, in combination with FIG. 3, when a row of sub-pixels spx in the display panel 200 are compensated, in the t01 stage, the control switch K0 is closed, and the voltage on the detection line SL is the voltage Vref of the reference voltage end VREF. The signal S1 controls the detection transistor T3 to turn off, the signal G1 transmitted on the scanning line controls the switch transistor T2 to turn on, so as to write the data voltage of the data signal end Data into the gate of the drive transistor T1, and control the drive transistor T1 to generate operating current Ids. In the t02 stage, the signal G1 transmitted on the scanning line controls the switch transistor T2 to turn off, and the signal S1 controls the detection transistor T3 to turn on, such that the operating current Ids generated by the drive transistor T1 flows into the detection line SL, that is, the detection line SL inputs constant current Ids. When the control switch K0 is switched to turn off from closed, the constant current Ids on the detection line SL charges the integrating capacitor C3, such that the voltage difference at two ends of the integrating capacitor C3 is as follows: Vc3=Ids*t/c3; and, t is the duration of t02 stage, c3 is the capacitance of the integrating capacitor C3. In this way, the output end of the second operational amplifier OP2 can output voltage Vout to the signal output end VO, and Vout=Vref−Vc3. In this way, the accuracy of the voltage Vc3 can be higher, and the detection accuracy can be improved. Afterwards, external compensation can be performed through voltage Vc3.

Based on the same inventive concept, embodiments of the present disclosure further provide a display device, as shown in FIG. 2 to FIG. 6, FIG. 8 and FIG. 9, the display device includes a display panel 200 and the above current detection device; the display panel 200 includes a display area DB and a non-display area NB; the display area DB includes a plurality of sub-pixels spx and a plurality of detection lines SL, and the non-display area NB includes a predetermined power line; each sub-pixel spx includes a pixel circuit; and one column of the pixel circuits are electrically connected with one detection line SL; the feedback compensation circuit 111 in each detection circuit 110 is respectively electrically connected with the predetermined power line; and the first end of the current detection circuit 112 in each detection circuit 110 is electrically connected to a respective one of detection lines SL in a display panel. It should be noted that, for the electrical connection manner between the display panel 200 and the current detection device, please refer to the above description, which will not be repeated redundantly herein.

In some embodiments, when each feedback compensation circuit 111 includes a noise extraction circuit 1111, the noise extraction circuit 1111 in each feedback compensation circuit 111 is electrically connected with the same position in the predetermined power line, thereby improving uniformity of the noise inversion signal fed back onto the detection line SL, and improving the uniformity of compensation.

In some embodiments, when each feedback compensation circuit 111 includes a plurality of noise extraction circuits 1111-*q*, in the same feedback compensation circuit 111, different noise extraction circuits 1111-*q* are electrically connected with different positions of the predetermined power line; and the noise extraction circuits 1111-*q* in different feedback compensation circuits 111 are electrically connected with the same position in the predetermined power line. For example, the noise extraction circuits 1111-1 in different feedback compensation circuits are electrically connected with the same position in the predetermined power line. The noise extraction circuits 1111-2 in different feedback compensation circuits 111 are electrically connected with the same position in the predetermined power line, thereby improving uniformity of the noise inversion signal fed back onto the detection line SL, and improving the uniformity of compensation.

In some embodiments, the display device may be a mobile phone, a tablet computer, a television, a display, a notebook computer, a digital photo frame, a navigator, or any other product or component with a display function. Other indispensable components of the display device are present as understood by those skilled in the art, and are not described herein, nor should they be construed as limiting the present disclosure.

In the current detection device and display device provided in embodiments of the present disclosure, the detection circuits are arranged in the non-display area of the display panel, and the detection circuit is connected to the detection line in the display area in a one-to-one correspondence. The detection circuit includes a feedback compensation circuit and a current detection circuit, the noise AC signal generated on the predetermined power line in the display panel is inverted through the feedback compensation circuit, to generate a noise inversion signal; then the noise inversion signal is provided to the first end of the current detection circuit. Since the first end of the current detection circuit is electrically connected with the detection line in the display panel, and the current detection circuit outputs detection signals to the signal output end according to the noise inversion signal, the signal on the detection line and the signal of the reference voltage end, in this way, the noise inversion signal can be compensated onto the detection line, then the noise inversion signal can neutralize the noise signals on the detection line, thereby further reducing influence of the noise signal on the current signal transmitted on the detection line, and improving detection accuracy.

Obviously, those skilled in the art can make various modifications and variations to the present disclosure without departing from the spirit and scope of the present disclosure. Thus, the present disclosure is also intended to encompass these modifications and variations thereto so long as the modifications and variations come into the scope of the claims of the present disclosure and their equivalents.

What is claimed is:

1. A current detection device, comprising:

a plurality of detection circuits;

wherein the detection circuits each is connected to a respective one of detection lines in a display panel; and the detection circuit comprises:

a feedback compensation circuit; and a current detection circuit;

wherein:

a first end of the feedback compensation circuit is electrically connected with a predetermined power line in the display panel;

a second end of the feedback compensation circuit is electrically connected with a first end of the current detection circuit;

the feedback compensation circuit is configured to:

generate a noise inversion signal by inverting a noise AC signal generated on the predetermined power line in the display panel; and provide the noise inversion signal to the first end of the current detection circuit;

the first end of the current detection circuit is directly connected with the respective one detection line in the display panel;

a second end of the current detection circuit is electrically connected with a reference voltage end;

an output end of the current detection circuit is electrically connected with a signal output end; and the current detection circuit is configured to output a detection signal to the signal output end according to the noise inversion signal, a signal on the detection line and a signal of the reference voltage end;

wherein the feedback compensation circuit comprises:

at least one noise extraction circuit, an inversion processing circuit, and a coupling circuit, wherein when each of the feedback compensation circuit comprises a plurality of noise extraction circuits, in the same feedback compensation circuit, different noise extraction circuits are electrically connected with different positions of the predetermined power line;

the at least one noise extraction circuit is configured to:

extract the noise AC signal at the electrically connected positions of the predetermined power line, and provide the noise AC signal to the inversion processing circuit;

when each of the feedback compensation circuit comprises one noise extraction circuit, the inversion processing circuit is configured to generate the noise inversion signal by inverting the noise signal provided by the noise extraction circuit or when each of the feedback compensation circuit comprises a plurality of noise extraction circuits, the inversion processing circuit is configured to generate the noise inversion signal by inverting the sum of the noise signals provided by the noise extraction circuits; and the coupling circuit is configured to:

receive the noise inversion signal, and couple the noise inversion signal to the first end of the current detection circuit;

wherein the coupling circuit comprises:

a coupling capacitor;

wherein:

a first end of the coupling capacitor is electrically connected with the inversion processing circuit, and a second end of the coupling capacitor is electrically connected with the first end of the current detection circuit.

2. The current detection device according to claim 1, wherein the noise extraction circuit comprises:

a blocking capacitor; and a first resistor;

wherein:

a first end of the blocking capacitor is electrically connected with the corresponding position of the predetermined power line, a second end of the blocking capacitor is electrically connected with a first end of the first resistor; and a second end of the first resistor is electrically connected with the inversion processing circuit.

3. The current detection device according to claim 1, wherein the inversion processing circuit comprises:

a second resistor; and a first operational amplifier;

wherein:

a negative phase input end of the first operational amplifier is electrically connected with the noise extraction circuit;

a positive phase input end of the first operational amplifier is electrically connected with the ground end;

an output end of the first operational amplifier is electrically connected with the coupling circuit;

a first end of the second resistor is electrically connected with the negative phase input end of the first operational amplifier; and the second end of the second resistor is electrically connected with the output end of the first operational amplifier.

4. The current detection device according to claim 1, wherein the display panel further comprises a plurality of scanning lines, and a plurality of overlap capacitors are formed by one of the detection lines and the plurality of scanning lines at overlapping positions; and a difference between a capacitance of the coupling capacitor and a capacitance of the overlap capacitor satisfies a difference threshold, wherein the difference threshold is $0\pm\Delta C$, $\Delta C\leq 0.1$.

5. The current detection device according to claim 1, wherein the current detection circuit comprises:

a second operational amplifier, an integrating capacitor, and a control switch;

wherein:

a negative phase input end of the second operational amplifier is taken as the first end of the current detection circuit;

a positive phase input end of the second operational amplifier is electrically connected with the reference voltage end;

an output end of the second operational amplifier is electrically connected with the signal output end;

a first end of the integrating capacitor is electrically connected with the negative phase input end of the second operational amplifier; and a second end of the integrating capacitor is electrically connected with the output end of the second operational amplifier;

a first end of the control switch is electrically connected with the negative phase input end of the second operational amplifier; and a second end of the control switch is electrically connected with the output end of the second operational amplifier.

6. The current detection device according to claim 5, wherein the current detection circuit further comprises:

a holding capacitor;

wherein:

a first end of the holding capacitor is electrically connected with the output end of the second operational amplifier, and a second end of the holding capacitor is electrically connected with a ground end.

7. A display device, comprising:

a display panel, and the current detection device according to claim 1;

wherein:

the display panel comprises a display area and a non-display area;

the display area comprises a plurality of sub-pixels and the plurality of detection lines, wherein each of the sub-pixels comprises a pixel circuit; and one column of the pixel circuits are electrically connected with one of the detection lines;

the non-display area comprises the predetermined power line;

the feedback compensation circuit in each of the detection circuits is electrically connected with the predetermined power line; and the first end of the current detection circuit in each of the detection circuits is electrically connected to a respective one of detection lines in a display panel.

8. The display device according to claim 7, wherein when each of the feedback compensation circuits comprises a noise extraction circuit, the noise extraction circuit in each of the feedback compensation circuits is electrically connected with the same position in the predetermined power line.

9. The display device according to claim 7, wherein when each of the feedback compensation circuit comprises a plurality of noise extraction circuits, in the same feedback compensation circuit, different noise extraction circuits are electrically connected with different positions of the predetermined power line; and the noise extraction circuits in different feedback compensation circuits are electrically connected with the same position in the predetermined power line.

10. The display device according to claim 7, wherein the noise extraction circuit comprises:

a blocking capacitor; and a first resistor;

wherein:

a first end of the blocking capacitor is electrically connected with the corresponding position of the predetermined power line;

a second end of the blocking capacitor is electrically connected with a first end of the first resistor; and a second end of the first resistor is electrically connected with the inversion processing circuit.

11. The display device according to claim 7, wherein the inversion processing circuit comprises:

a second resistor; and a first operational amplifier;

wherein:

a negative phase input end of the first operational amplifier is electrically connected with the noise extraction circuit;

a positive phase input end of the first operational amplifier is electrically connected with the ground end;

an output end of the first operational amplifier is electrically connected with the coupling circuit;

a first end of the second resistor is electrically connected with the negative phase input end of the first operational amplifier; and the second end of the second resistor is electrically connected with the output end of the first operational amplifier.

12. The display device according to claim 7, wherein the display panel further comprises a plurality of scanning lines, and a plurality of overlap capacitors are formed by one of the detection lines and the plurality of scanning lines at overlapping positions; and a difference between a capacitance of the coupling capacitor and a capacitance of the overlap capacitor satisfies a difference threshold, wherein the difference threshold is $0\pm\Delta C$, $\Delta C\leq 0.1$.

13. The display device according to claim 7, wherein the current detection circuit comprises:

a second operational amplifier, an integrating capacitor, and a control switch;

wherein:

a negative phase input end of the second operational amplifier is taken as the first end of the current detection circuit;

a positive phase input end of the second operational amplifier is electrically connected with the reference voltage end;

an output end of the second operational amplifier is electrically connected with the signal output end;

a first end of the integrating capacitor is electrically connected with the negative phase input end of the second operational amplifier; and a second end of the integrating capacitor is electrically connected with the output end of the second operational amplifier;

a first end of the control switch is electrically connected with the negative phase input end of the second operational amplifier; and a second end of the control switch is electrically connected with the output end of the second operational amplifier.

14. The display device according to claim 13, wherein the current detection circuit further comprises:

a holding capacitor;

wherein:

a first end of the holding capacitor is electrically connected with the output end of the second operational amplifier, and a second end of the holding capacitor is electrically connected with a ground end.

* * * * *